United States Patent [19]

Ellwein

[11] Patent Number: 4,591,152

[45] Date of Patent: May 27, 1986

[54] TOY COMPRISING INTERCONNECTING RODS

[75] Inventor: Clarence G. Ellwein, Spokane, Wash.

[73] Assignees: Laura Ellwein; Mark D. Ellwein; Andrew G. Ellwein, all of Spokane, Wash. ; a part interest to each

[21] Appl. No.: 545,502

[22] Filed: Oct. 26, 1983

[51] Int. Cl.[4] ..... A63F 9/00

[52] U.S. Cl. ..... 273/1 GG; 446/85

[58] Field of Search ..... 446/85, 102, 124, 125, 446/396, 491; 273/1 R, 1 GG, 1 GF, 275

[56] References Cited

U.S. PATENT DOCUMENTS 2,712,444 7/1955 Reed ..... 273/1 GG 3,484,985 12/1969 Castell ..... 273/1 GF

*Primary Examiner*—Mickey Yu

*Attorney, Agent, or Firm*—Harvey B. Jacobson

[57] ABSTRACT

Amusement apparatus forming a toy or game having a plurality of rod-like elements which are linked up serially end-to-end to form a chain. A user holds one element in his or her hand and uses the one element to link up with a second element. The process is repeated from element to element until the supply of elements is depleted or until the chain is broken. The elements each have a ring at one end and a cranked portion at the other end. The cranked portion fits through the ring of an adjacent element in the chain to form an over-and-under connection between the elements.

12 Claims, 6 Drawing Figures

TOY COMPRISING INTERCONNECTING RODS

BACKGROUND OF THE INVENTION

This invention relates to an amusement apparatus forming a toy or game, and includes a plurality of rod-like elements which are to be serially interconnected end-to-end by a player, to form a chain, the player starting by holding one element in his or her hand and using the one element to link up with a second element, using the second element to link up with a third element, and so on, the object being to link up as many elements as possible without breaking the chain.

DESCRIPTION OF THE PRIOR ART

The following U.S. patents disclose toys or games comprising link-up type elements. None of the elements shown in these patents, however, has the form of elements made in accordance with the present invention:

| | |
|---|---|
| 3,092,384 | June 4, 1963 |
| 3,414,265 | Dec. 3, 1968 |
| 3,460,831 | Aug. 4, 1969 |
| 3,550,311 | Dec. 29, 1970 |
| 3,690,656 | Sept. 12, 1972 |
| 4,071,244 | Jan. 31, 1978 |

SUMMARY OF THE INVENTION

In accordance with the invention, rod-like, link-up type elements for use in amusement apparatus of the type described have a particular configuration which facilitates the serial linking up of elements into a chain and enhances the enjoyment of a user. Each element, in accordance with the invention, may, for example, have a ring at one end and a cranked portion at the other end adapted to fit through the ring of an adjacent element to form an over-and-under connection between the elements, with a bend in the one element which defines the cranked portion resting on the outer ring portion of the adjacent element, and the extremity of the cranked portion of the one element engaging under a part of the adjacent element from which the ring extends.

Additionally, the elements may be provided with a central flange to provide convenient orientation of the elements facilitating link-up when the elements are disposed on a support surface. To provide an additional dimension in constructing the chain, respective elements may carry sequence markings such as letters or numbers signifying the order in which they are to be linked together. The ring ends of the elements may be formed in various different configurations such as facsimiles of people or animals.

These together with other objects and advantages which will become subsequently apparent reside in the details of construction and operation as more fully hereinafter described and claimed, reference being had to the accompanying drawings forming a part hereof, wherein like numerals refer to like parts throughout.

BACKGROUND OF THE INVENTION

Figure 1:
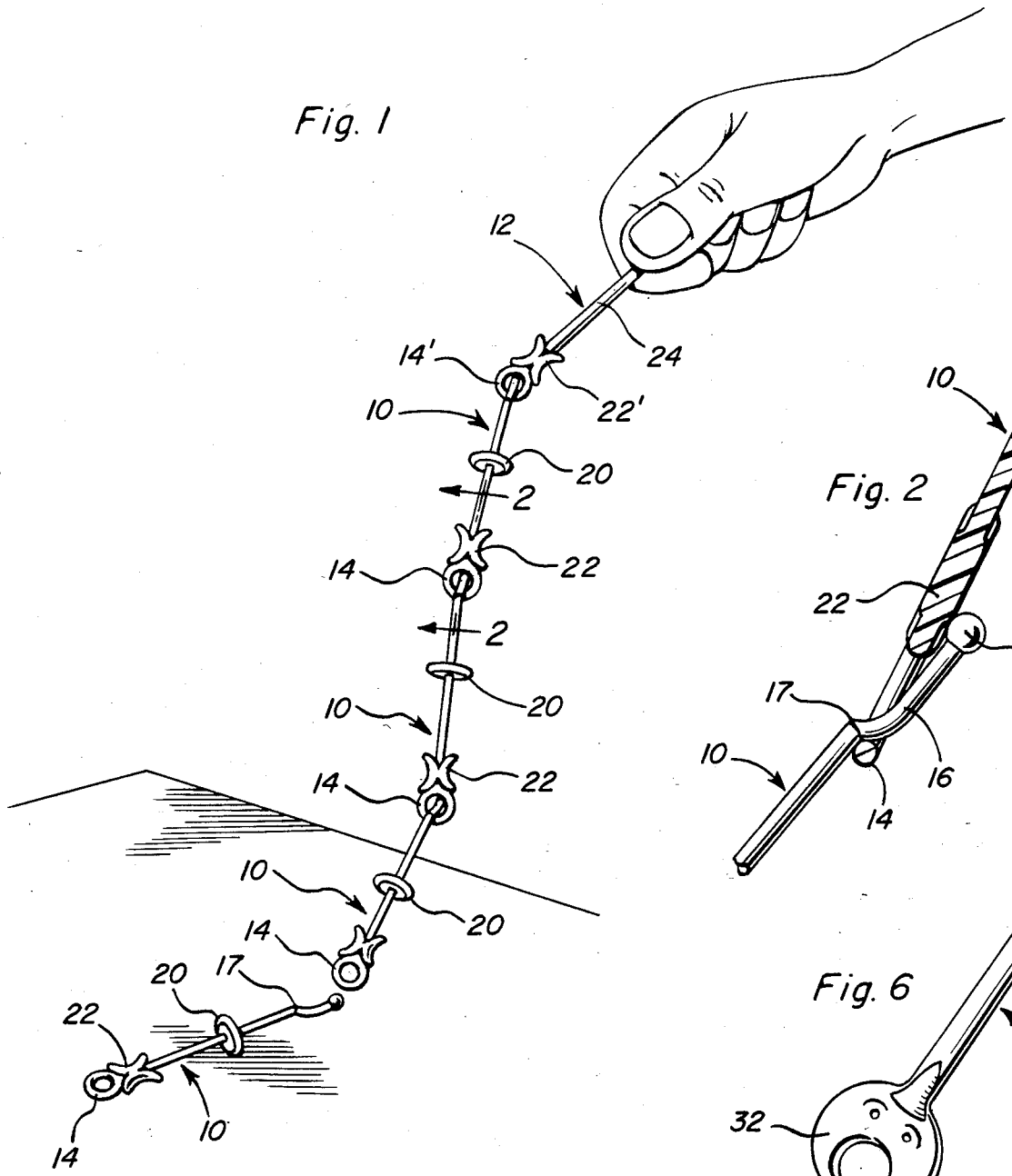
FIG. 1 is a perspective view of an amusement apparatus comprising rod-like elements in accordance with the invention, and showing the manner of use of the apparatus.
Figure 3:
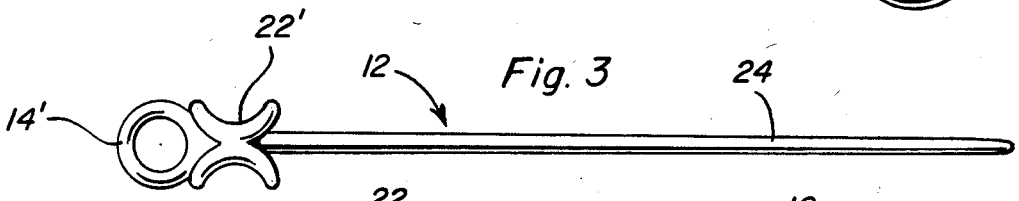
FIG. 3 is a plan view of a starter element of the apparatus.

The illustrated amusement apparatus in accordance with the invention comprises a plurality of rod-like connector elements 10 (shown individually in FIGS. 4 and 5) and a starter element 12 (shown in FIG. 3). In use, the connector elements may be distributed on a support surface 14 (FIG. 1) and the starter element held by a user in one hand. Then, the starter element is used to link up with a first connector element and lift the first connector element from the support surface using only the one hand. Subsequently, the first connector element is used to link up with the second connector element and lift the second connector element from the surface. The process is repeated with successive connector elements, to form a chain (always using only the one hand) the object being to link up and lift as many connector elements as possible, until the supply is depleted, or until the chain is broken.

Figure 4:
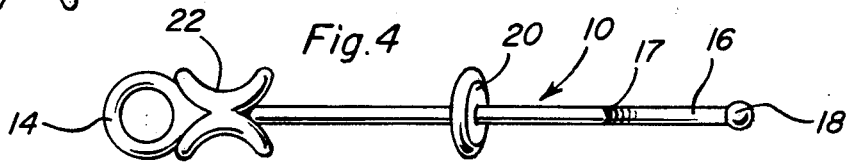
FIG. 4 is a plan view of one of the remaining elements of the apparatus.
Figure 5:
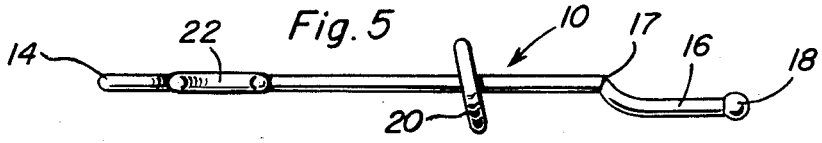
FIG. 5 is an elevational view of the elements shown in FIG. 4.

Referring more particularly to FIGS. 4 and 5, each individual connector element 10 may comprise an elongate rod of molded plastic having a circular ring 14 at one end, and a cranked or offset portion 16 at the other end terminating in a knob 18 at the extremity of the cranked portion. Intermediate its length, element 10 may have an inclined circular flange 20 which, when the element rests on the support surface, orients the element in a manner facilitating access to its opposite ends for linking up with an adjacent element in the chain. Adjacent ring 14, element 10 has a flat substantially cruciform portion 22 which assists in balancing the element and provides a surface for the knob 18 of an adjacent element in the chain to rest against as shown in FIG. 2.

Starter element 12 (see FIG. 3) comprises a straight rod portion 24 somewhat longer than the connector elements 10, and an end ring 14' and an adjacent cruciform portion 22' similar to the equivalent portions of the connector elements. The starter element may also be molded in plastic.

In use, the connector elements are distributed on the support surface and the starter element is gripped in the hand with ring 14' exposed. A link-up is made between the starter element and a first connector element by passing ring 14' over and along the cranked portion 16 of the connector element to form an over-and-under connection. Then, a second connector element is linked up with the first connector element in a similar manner. The process is continued, linking connector element to connector element, until all the elements are used, or until the chain is broken by disengagement of respective elements.

Figure 2:
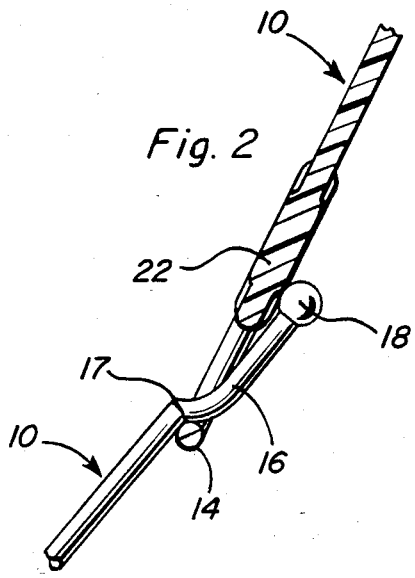
FIG. 2 is a sectional view on line 2—2 of FIG. 1.
Figure 6:
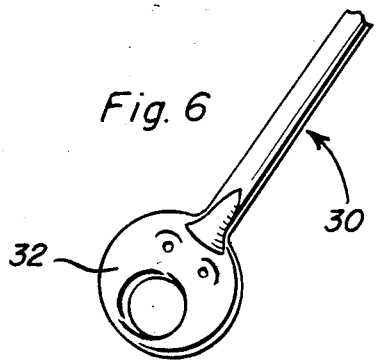
FIG. 6 is a plan view of part of a modified element in accordance with the invention.

In each over-and-under inter-element connection, as best shown in FIG. 2, a bend 17 defining the junction of the cranked portion of a succeeding element rests on the ring 14 of a preceding element, and knob 18 of the succeeding element engages against the undersurface of cruciform portion 22 of the preceding element. The cranked portions of the respective elements each have a length which provides for this form of connection which is particularly effective for serially linking the elements together into a chain. The connector and starter elements can be made in various configurations. For example, FIG. 6 illustrates an element 30 wherein the ring end 32 is formed as a facsimile of a clown. Also, the elements may be made in different colors, and they may each carry different letters or numbers of a sequence.

The invention provides an economic manufactured game of skill which can be readily transported, used in relatively confined spaces, and enjoyed by different age groups.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An amusement apparatus comprising a plurality of rod-like elements linked up serially into a chain by a user holding one element in his or her hand, having linked the one element to a second element of the chain, and repeated the link-up procedure with successive elements, each element having an opening at one end and an elongate portion at the other end received through the opening of an adjacent element in the chain to form an over-and-under connection between the elements.

2. An amusement apparatus comprising a plurality of rod-like elements adapted to be linked up serially to form a chain by a user holding one element in his or her hand, linking the one element to a second element of the chain, and repeating the link-up procedure with successive elements until the supply of elements is depleted or until the chain is broken, each element having an opening at one end and an elongate portion at the other end adapted to be received through the opening of an adjacent element in the chain to form an over-and-under connection between the elements, wherein said opening in each element is defined by a ring at said one end of the element, said elongate portion of each element comprising a substantially linear cranked portion of the element, and wherein, with the cranked portion received through the ring of said adjacent element, a bend defining the cranked portion rests on the ring of said adjacent element with the extremity of the cranked portion engaging under a surface of the adjacent element from which the ring extends.

3. The apparatus as defined in claim 2 wherein the extremity of the cranked portion is formed as a knob.

4. The apparatus as defined in claim 2 wherein each element includes a flange between the ring and the cranked portion to orient the element on a support surface in a manner facilitating link-up with a preceding element in the chain.

5. The invention of claim 2 including a starter element having a ring at one end and an elongated shank absent of cranked portion extending from the ring for gripping in the user's hand to commence the chain-making procedure.

6. A rod-like element for use in amusement apparatus with further like elements to form a chain by serially linking the elements end-to-end, said element having a ring at one end and a cranked portion at the other end, the cranked portion being adapted for receipt through the ring of an adjacent element in the chain to provide an over-and-under connection between the elements, with a bend defining the cranked portion resting on the ring of the adjacent element, and the extremity of the cranked portion engaging under a surface of the adjacent element from which the ring extends wherein the element includes a flange between the ring and the cranked portion for orienting the element on a support surface in a manner facilitating link-up with a preceding element in the chain.

7. The invention of claim 6 wherein the element includes a flat portion from which the ring extends and against which the extremity of an adjacent element engages when the elements are linked together.

8. A rod-like element for use in amusement apparatus with further like elements to form a chain by serially linking the elements end-to-end, said element having a ring at one end and a cranked portion at the other end, the cranked portion being adapted for receipt through the ring of an adjacent element in the chain to provide an over-and-under connection between the elements, with a bend defining the cranked portion resting on the ring of the adjacent element, and the extremity of the cranked portion engaging under a surface of the adjacent element from which the ring extends wherein in the element includes a flat portion from which the ring extends and against which the extremity of an adjacent element engages when the elements are linked together.

9. The invention of claim 8 wherein the extremity of the cranked portion is formed by a knob.

10. The invention of claim 8 wherein the ring is circular.

11. The invention of claim 8 wherein the flat portion is of substantially cruciform shape.

12. The invention of claim 8 wherein the element includes a flange between the ring and cranked portion for orienting the element on a support surface in a manner facilitating link-up with a preceding element in the chain.

* * * * *